US010926977B2

(12) United States Patent
Steiner et al.

(10) Patent No.: US 10,926,977 B2
(45) Date of Patent: Feb. 23, 2021

(54) ELEVATOR CAR WITH LADDER REMOVABLE FROM THE INTERIOR

(71) Applicant: Inventio AG, Hergiswil (CH)

(72) Inventors: Adrian Steiner, Inwil (CH); Alessandro D'Apice, Ebikon (CH); Marcel Nicole, Stansstad (CH)

(73) Assignee: INVENTIO AG, Hergiswil (CH)

( * ) Notice: Subject to any disclaimer, the term of this patent is extended or adjusted under 35 U.S.C. 154(b) by 235 days.

(21) Appl. No.: 15/754,011

(22) PCT Filed: Aug. 18, 2016

(86) PCT No.: PCT/EP2016/069553
§ 371 (c)(1),
(2) Date: Feb. 21, 2018

(87) PCT Pub. No.: WO2017/032671
PCT Pub. Date: Mar. 2, 2017

(65) Prior Publication Data

US 2018/0244497 A1 Aug. 30, 2018

(30) Foreign Application Priority Data

Aug. 27, 2015 (EP) ..... 15182718

(51) Int. Cl.
*B66B 11/02* (2006.01)
*B66B 5/02* (2006.01)

(52) U.S. Cl.
CPC ..... *B66B 11/0226* (2013.01); *B66B 5/027* (2013.01)

(58) Field of Classification Search
CPC .. B66B 5/027; B66B 11/0246; B66B 11/0226
See application file for complete search history.

(56) References Cited

U.S. PATENT DOCUMENTS 2,148,099 A 2/1939 Bray
2012/0325582 A1* 12/2012 Bloch ..... B66B 11/0226 182/129
2017/0240380 A1* 8/2017 Reuter ..... B66B 11/0226

FOREIGN PATENT DOCUMENTS

CN 101304938 A 11/2008
CN 102718112 A 10/2012
CN 203333111 U 12/2013
(Continued)

OTHER PUBLICATIONS

English Machine Translation of WO 2016/208071.*

*Primary Examiner* — Diem M Tran
(74) *Attorney, Agent, or Firm* — William J. Clemens; Shumaker, Loop & Kendrick, LLP

(57) ABSTRACT

An elevator car with special measures for evacuation has several side walls, a floor and a ceiling, which together enclose an interior of the elevator car. The elevator car has a flap arranged on one of the side walls and a ladder for evacuating persons from the interior of the elevator car. The flap is movable between a closed state, in which the flap blocks access from the interior of the elevator car to an area behind the flap, and an open state, in which access is possible from the interior of the elevator car to the area behind the flap. The flap has a height less than the height of the side walls. In the closed state of the flap, the ladder is arranged in the area behind the flap. The ladder is removable from behind the flap and can be increased in length for the evacuation.

15 Claims, 3 Drawing Sheets

(56) References Cited

FOREIGN PATENT DOCUMENTS

| | | | | | |
|---|---|---|---|---|---|
| EP | 0870722 | B1 | | 10/2002 | |
| EP | 1988049 | A1 | | 11/2008 | |
| JP | H0494385 | A | | 3/1992 | |
| WO | 03051755 | A1 | | 6/2003 | |
| WO | WO-2016208071 | A1 | * | 12/2016 | ..... B66B 11/02 |

* cited by examiner

ELEVATOR CAR WITH LADDER REMOVABLE FROM THE INTERIOR

FIELD

The present invention relates to a car for an elevator. Elevators are used in particular to transport persons within buildings in a vertical or at least approximately vertical direction in order to be able to bring them, for example, from one floor to another floor. In the case of an elevator malfunction, for example, it may be necessary to evacuate persons from an elevator car. If it should not be possible to move the elevator car to a floor and to open its doors there, it may be necessary to take measures so that the persons in the elevator car can leave the elevator car in a different way and that they can, for example, be evacuated through an elevator shaft. For this purpose, provisions can be made for a hatch in a ceiling of the elevator car, through which the persons in the elevator car can get to the roof of the elevator car.

BACKGROUND

EP 1 988 049 A1 describes, for example, a safety feature for an elevator car with a hinged roof hatch and a telescopic ladder. The telescopic ladder is accommodated here in a space between a car ceiling and suspended ceiling panels.

An elevator car with a two-part ladder assembly is known from JP H04 94385 A, wherein the ladder arrangement consists of ladder rungs that are firmly set in an upper half of a car side wall as well as a mobile ladder part. The ladder assembly is arranged behind a sliding cover in a car side wall. To evacuate persons from the car, the cover can be moved downward against the car floor, whereupon now the aforementioned mobile ladder part is removed, placed on the car floor, and inclined against the car side wall.

In U.S. Pat. No. 2,148,099, a ladder in a closed state is integrated in a car floor comprising a removable tread plate.

It was recognized that traditional measures taken to facilitate an evacuation from an elevator car cause some problems in practical use. In particular, the handling of ladders traditionally provided for this purpose has proven to be difficult.

There may, therefore, be a need for an elevator car that facilitates an easier evacuation from the elevator car in case passengers cannot leave the elevator car in the normal way through a car door.

SUMMARY

According to one aspect of the invention, an elevator car is proposed that comprises several side walls, a floor, and a ceiling which together surround an interior of the elevator car. Furthermore, the elevator car comprises a flap arranged at one of the side walls. In addition, the elevator car comprises a ladder for evacuating persons from the interior of the elevator car. The flap is arranged and designed such that it is movable between a closed state, in which the flap blocks access from the interior of the elevator car to an area behind the flap, and an open state, in which access is possible from the interior of the elevator car to the area behind the flap through a pivoting movement. The flap is to have a height here that is less than the height of the side walls. The term height of the side walls is understood as the distance between the floor and the ceiling of the elevator car. The flap and the ladder are designed here such that the ladder is to be arranged in the area behind the flap when the flap is in the closed state. Furthermore, the flap and the ladder are to be designed such that the ladder can be removed from the flap when the flap is in the open state. The ladder is to be designed here such that it can be extended in its length, for example in the event of an evacuation.

One idea that this aspect of the invention is based on can be, among other things, that a ladder that is extendable in its size is to be kept in the elevator car in such a way that passengers in the elevator car can easily reach it and that it can therefore be used to more easily evacuate the passengers from the elevator car. Instead of storing the ladder on a ceiling of the elevator car, where it may be difficult to reach by passengers who do not, for example, have the necessary height for doing so, it is proposed to arrange the ladder behind a flap that is provided in one of the side walls of the elevator car. The flap can be provided in an area that is close to the floor of the elevator car so that it is easy to reach for smaller persons as well.

The area behind the flap should be adequately sized to accommodate the ladder that is adjustable in its length at least in a state in which the ladder was brought to the smallest possible pack size. A height and width of the flap should therefore be slightly bigger than a height and width of the ladder brought to the smallest possible pack size. A chosen depth of the area behind the flap should be sufficiently large enough to accommodate the ladder brought to the pack size in this area when the flap is in the closed state.

Preferably, the flap should have a height that is less than half the height of the side walls. If the flap is arranged as far down as possible, i.e., close to the floor of the elevator car, in the associated side wall, an upper edge of the flap is therefore located at the most at approximately half the height of the elevator car. Consequently, this upper edge is easy to reach for short passengers as well. The flap may, for example, have a height of less than 1.5 m, preferably less than 1 m.

A ladder to be accommodated behind the flap also has, in this case, a length in the packed state that is less than half the height of the side walls. Therefore, a ladder packed in such a way can easily be removed when the flap is open and operated inside the elevator car.

According to one embodiment, the flap may be attached to other structures in a lower area of the elevator car by means of a hinge arrangement so that it can be opened to the open state by rotating it around a horizontal axis of rotation.

In other words, it should not be possible to open the flap, similar to a door, by rotating it around a vertical axis of rotation. Instead, it is considered advantageous to place the rotatable flap in the lower area of the elevator car, i.e., close to the floor of the elevator car. To this purpose, the flap may, for example, comprise a hinge arrangement which can be attached to the flap on the one side and to other structures of the elevator car on the other side, such as, for example, the floor of the elevator car or an upwardly projecting part of a side wall above this floor. The flap can then be rotated from its closed state to the open state and vice versa around a horizontal axis of rotation of this hinge arrangement.

In the closed state, the flap can be in a vertical plane, preferably parallel to or respectively in continuation to the side wall of the elevator car in which the flap is accommodated. In the rotatable state open toward the interior of the elevator car, the flap protrudes at least in its upper area into the elevator car so that access to the area behind the flap is provided. This way, passengers in the interior can easily remove the ladder accommodated in this area behind the flap.

One mechanical stop or a plurality of mechanical stops may be provided on the flap and/or the hinge arrangement to be able to keep the flap, for example, in its closed state and/or its open state and to prevent the flap from swinging past a desired oblique arrangement, for example when the flap is open. In this oblique arrangement, the ladder can, for example, simply be pulled out of the flap in the upward direction.

The ladder may, for example, be a telescopic ladder. Such a telescopic ladder can be increased in length, for example, by moving parts of the telescopic ladder relative to each other in their longitudinal direction and then fixing them in relation to each other. The telescopic ladder may consist of two or more parts that are movable and fixable relative to each other.

Alternatively or additionally, the ladder may comprise a plurality of longitudinally connectable portions. In other words, the ladder may have two or more parts, wherein a length of the ladder can be longitudinally increased by successively connecting the individual portions with each other.

The ladder may be preferably designed such that its length in a packed state can be reduced so that the ladder fits into the area behind the flap when the flap is in its closed state. On the other hand, the ladder may be designed such that it can be increased to a much greater length by telescopically extending and/or assembling a plurality of connectable portions, for example to a length which is at least twice as large as the length of the ladder in the packed state.

Preferably, the flap has a holding arrangement with which the ladder can be detachably secured to a side of the flap that is opposite to the interior of the elevator car. In other words, arrangements may be provided on the flap to secure the ladder in its packed state on the side of the flap that faces the area behind the flap. The ladder can therefore firmly be held on the flap, in particular in the closed state of the flap. This way, any shaking and possibly associated clattering of the ladder accommodated in the space behind the flap can be avoided. The ladder should, however, be attached to the flap in such a way that it is easy to detach from the flap to be able to easily remove it from the flap, for example in the case of a necessary evacuation.

Furthermore, the flap may have a locking arrangement with which the flap can be locked in its closed position. The locking arrangement can, for example, prevent the flap from inadvertently opening from the closed to the open state and/or the flap from opening without authorization.

The locking arrangement can, for example, comprise a movable latch which is arranged, formed, and movable in such a way that it immobilizes the flap in a closed state relative to the surrounding structures in the elevator car and that it releases such an immobilization in an open state. The latch can be arranged on the flap itself and engage in a surrounding structure of the elevator car for example to lock and immobilize the flap, or it may engage behind such a structure, i.e., for example in an adjoining area of a side wall. Alternatively, the latch can also be arranged on the surrounding structure of the elevator car, i.e., for example on the adjacent side wall and engage for example in a recess in the flap to lock and immobilize the flap.

Preferably, the locking arrangement may be adapted to be locked and unlocked with a separate tool. Such a separate tool may be, for example, a simple tool such as, for example, a screwdriver. Due to the fact that the locking arrangement can only be operated with a separate tool, it can be made more difficult for the flap to be opened unintentionally or without authorization. The separate tool may, in particular, be a more specific tool such as a male triangular wrench or square key wrench, which ordinary passengers of the elevator car normally do not have available, so that it can be avoided, for example, that these are able to open the flap and to get to the ladder behind it without the support of an authorized person such as a firefighter. An unauthorized evacuation of the elevator car by means of the ladder or a theft of the ladder can be made more difficult in this way.

Alternatively, the locking arrangement can be secured against unauthorized use by means of a lock.

The flap may preferably be configured and arranged such that, in the closed state, it is flush with the side wall on the side where it is arranged. In other words, the surface of the flap facing the interior of the elevator car in the closed state preferably extends in a same plane as the adjoining side wall in which the flap is arranged. This can, at the same time, improve the visual appearance in the elevator car and help minimize an otherwise existing risk of injury due to components protruding into the interior of the elevator car. The area behind the flap in which the ladder is to be accommodated extends in this case on a side facing away from the exterior of the elevator car on a plane through the side wall and the flap.

In one embodiment, the flap may be part of the wall box that is incorporated in the side wall of the elevator car. Such a wall box may be provided as a separate component of the elevator car. The wall box can thus form a type of module that can be mounted in and/or to the elevator car. Such a modular wall box can be preassembled and/or prefabricated and, for example, installed as a unit.

The wall box may comprise the flap on its side facing the interior of the elevator car. In addition, the wall box may have a back wall and laterally delimiting side walls spaced from the flap. This way, the wall box can enclose the area behind the flap so that in this area the ladder can be arranged in the wall box and is protected from outside influences.

In order to, in particular, be able to evacuate the elevator car, an exit hatch may be provided in the ceiling of the elevator car. This exit hatch may be opened when necessary and be sized such that a passenger can get through the exit hatch to the roof of the elevator car.

The ladder kept inside the elevator car can be preferably configured in such a way that it has a length in an extended state that is greater than the height of the side walls. If an evacuation becomes necessary, the ladder can be removed from the flap and converted from its packed state to its extended state to then be able to get to the exit hatch by means of the ladder.

In addition, the elevator car may comprise a fixing device located at the outside of the elevator car, which is adapted to affix the ladder to the outside of the elevator car. In the event of an evacuation, passengers can leave the interior of the elevator car first with the help of the ladder kept there through the exit hatch. Then, the ladder can be pulled through the exit hatch to the roof of the elevator car and subsequently affixed there with the help of the fixing device kept at the outside of the elevator car. The same ladder can therefore also be used to get from the roof of the elevator car, for example, further upward to an elevator shaft exit.

Alternatively or additionally, a second ladder may be affixed on the outside of the elevator car. This second ladder can, for example, be longer than the first ladder accessible in the interior of the elevator car and be handled there. In particular, the second ladder does not necessarily have to be changeable in its length because it does not have to be accommodated in the cramped interior of the elevator car.

It should be noted that some of the possible features and advantages of the invention are described here with reference to different embodiments. A person skilled in the art recognizes that the features may be combined, adapted, or exchanged as appropriate in order to yield other embodiments of the present invention.

DESCRIPTION OF THE DRAWINGS

Embodiments of the present invention are described below with reference to the accompanying drawings, wherein neither the drawings nor the description are to be interpreted as limiting the present invention.

The drawings are only schematic and are not true to scale. Like reference signs refer in different drawings to like or analogous features.

DETAILED DESCRIPTION

Figure 1:
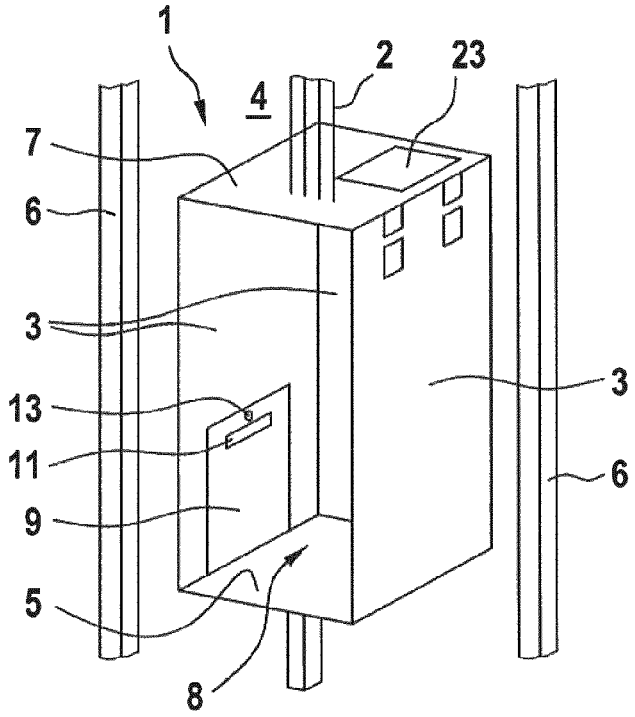
FIG. 1 shows an elevator car according to the invention with a flap in the closed state.

FIG. 1 illustrates an elevator car 1 according to one embodiment of the present invention. The elevator car 1 is held by suspension means 2 for example in the form of suspension cables or suspension straps and can with these be vertically moved inside an elevator shaft 4 (only schematically illustrated with the help of parts of an elevator shaft 6).

The elevator car 1 is box-shaped and has three side walls 3, a floor 5, and a ceiling 7. The elevator car 1 is open toward a front side or limited by an openable elevator door (not shown for clarity). The side walls 3, the floor 5, and the ceiling 7 surround an interior 8 of the elevator car which may carry passengers.

A flap 9 is arranged at one of the side walls 3. The flap 9 has a height which, measured in the extending direction of the suspension means 2 holding the car 1, i.e., a longitudinally extending direction of the elevator shaft 4, is less than half the height of the side walls 3. In an upper area, the flap 9 has a handle 11 as well as an outwardly exposed connecting piece 13 of a locking arrangement.

The flap 9 can be switched between a closed state and an open state. In the closed state as shown in FIG. 1, the flap 9 blocks access from the interior 8 to an area behind the flap 9. In this closed state, the flap 9 is disposed substantially flush with the adjoining side wall 3.

Figure 2:
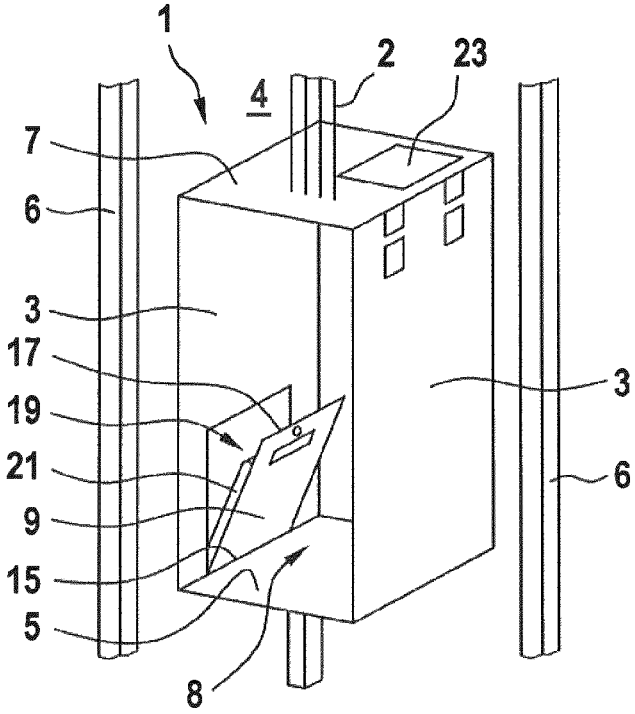
FIG. 2 shows the elevator car illustrated in FIG. 1 in the open state.

FIG. 2 illustrates the elevator car with a flap 9 in the open state. An edge 15 of the flap 9 pointing to the floor 5 is hinged with another structure, for example the floor 5 of the elevator car 1. The flap 9 can therefore be rotated in the open state around a horizontal axis of rotation arranged in the lower area of the flap 9. In this open state, the edge 17 opposite the lower edge 15 protrudes into the interior 8 of the elevator car 1 and thus provides access to the area 19 behind the flap 9.

This area 19 behind the flap 9 accommodates a ladder 21 in the closed state of the flap 9. This ladder 21 is variable in its length. The ladder 21 may, for example, be a telescopic ladder, a ladder composed of several parts, or a folding ladder. The ladder 21 is stored in the area 19 behind the flap 9 in a packed and size-reduced state. The dimensions of the flap 9 and the area 19 behind it are sufficiently dimensioned to accommodate the ladder 21 in the area 19 without any problems.

Figure 3:
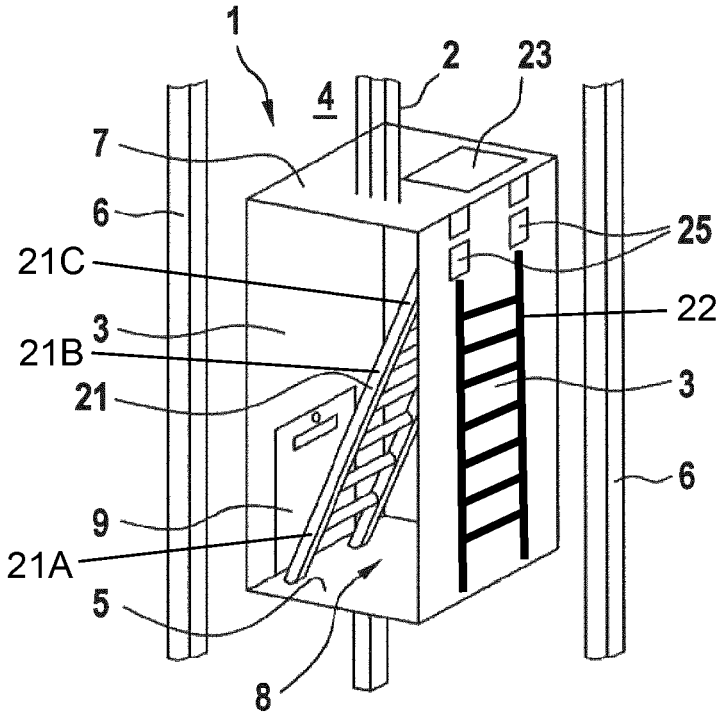
FIG. 3 shows the elevator car illustrated in FIG. 1 with a ladder removed from the flap.

In the event of an elevator failure, for example, passengers in the interior 8 of the elevator car 1 may remove the ladder 21 from the area 19 behind the flap 9. The low overall height of the flap 9 as well as the small packing size of the ladder 21 in the packed state can simplify here the handling of the ladder 21 inside the cramped interior 8 of the elevator car. Then, the ladder 21 can be increased in length. A telescopic ladder can be pushed out or a ladder consisting of several parts can be made longer by connecting the parts. This way, the ladder 21 can reach a length that enables the passengers to reach the roof of the elevator car 1 through an exit hatch 23 arranged at the ceiling 7 of the elevator car 1. FIG. 3 shows the elevator car 1 with the ladder 21 removed from the flap 9 and then extended by longitudinally connectable parts 21A, 21B and 21C.

Once the passengers have reached the roof of the elevator car 1, they may, if necessary, pull the ladder 21 upward through the roof hatch 23. Then, they can attach the ladder 21 to the elevator car 1 by means of a fixing device 25 which is attached to an outside of the elevator car 1. Subsequently, the passengers can use the ladder 21 fixed in such a manner to reach an exit from the elevator shaft 4. The fixing device 25 could, for example, comprise latching means to establish a latching connection.

Alternatively, another ladder 22 can be provided at the outside of the car 1 which, in the case of an evacuation of the elevator car 1, can be used by the passengers to get from the roof of the elevator car 1 to an exit from the elevator shaft 4. This additional ladder 22 may, if necessary, be configured differently, particularly bigger, than the ladder 21 made available and be rendered usable in the interior 8 of the elevator car 1.

Figure 4:
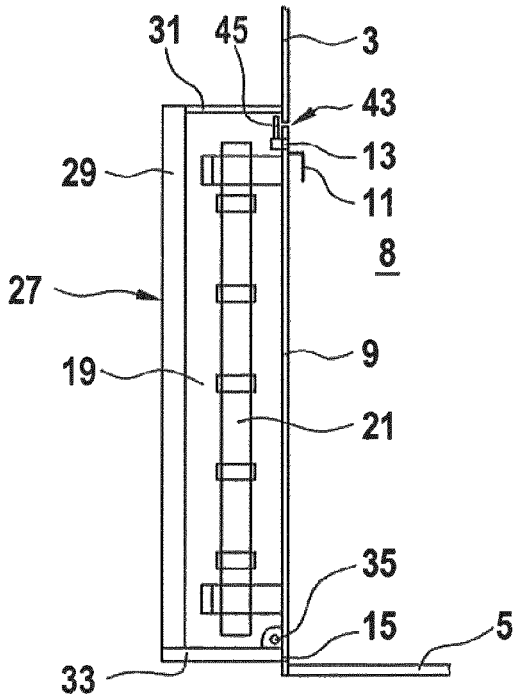
FIG. 4 shows a sectional view through a wall box for an elevator car according to the invention with a flap in the closed state.
Figure 5:
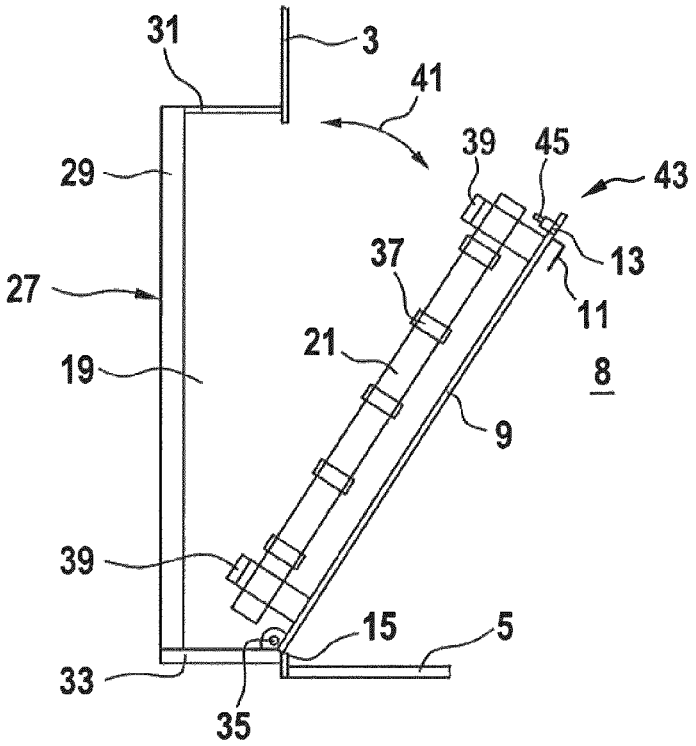
FIG. 5 shows a sectional view through the wall box shown in FIG. 4 with the flap in the open state.

FIG. 4 and FIG. 5 both show a sectional view of a portion of an elevator car 1. In this embodiment, the flap 9 is part of a wall box 27 in which the ladder 21 can be accommodated and stored. The wall box 27 extends, viewed from the interior 8 of the elevator car 1, behind a plane formed by the side wall 3.

The wall box 27 is a rectangular box in the illustrated example whose back wall 29, top and bottom walls 31, 33, as well as side walls (not shown in the sectional view) are firmly connected with the structures of the elevator car 1 such as, for example, the side wall 3 or the floor 5. The flap 9 is connected through a hinge arrangement 35 with one of these fixed structures or with one of the walls 29, 31, 33 of the wall box 27. In the example shown, the hinge arrangement 35 is arranged on or respectively close to the bottom edge 15 of the flap 9 so that the flap 9 can be swung open around a horizontal axis of rotation of this hinge arrangement 35 toward the interior 8 of the elevator car 1, as illustrated by the arrow 41 in FIG. 5.

In the example shown, the ladder 21 is detachably affixed in its packed, size-reduced state to a back side of the flap 9, i.e., the side that is opposite to the interior 8 of the elevator car 1. For this reason, a holding arrangement 39 is provided on the flap 9. This holding arrangement 39 is configured such that the ladder 21 along with its rungs 37 can be kept at a slight distance to the flap 9 so that the ladder 21 cannot shake or generate rattling sounds while stored in the wall box 27. The holding arrangement 39 is configured such that it can simply release the ladder 21 so that the ladder 21 can simply be removed from the wall box 27 in the case of an evacuation when the flap 9 is opened.

Both the handle 11 and the connecting piece 13 as well as the locking arrangement 43 are provided close to the upper edge 17 of the flap 9. In the illustrated example, the locking arrangement 43 is shown in the form of a rotatable latch 45, which is rotated through the connecting part 13 by means of a separate tool such as a male triangular wrench. In a closed state, the latch 45 latches behind an edge of the side wall 3 and thus locks the flap 9 in its closed position. When the latch 45 is rotated by means of the tool, the locking arrangement 43 opens so that the flap 9 can be brought to its open state.

Finally, it should be noted that terms such as "comprising" and the like do not preclude other elements or steps, and terms such as "a" or "one" do not preclude a plurality. It should also be noted that features that have been described with reference to one of the above embodiments may also be used in combination with other features of other embodiments described above. Reference signs in the claims should not be considered limiting.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car, comprising:

a plurality of side walls, a floor and a ceiling together enclosing an interior of the elevator car, whereby the floor and the ceiling are distanced from each other by a height of the side walls;

a ladder for evacuating persons from the interior of the elevator car;

a flap arranged on one of the side walls of the elevator car;

wherein the flap is movable through a rotating movement between a closed state whereby the flap blocks access from the interior of the elevator car to an area behind the flap, and an open state whereby access is possible from the interior of the elevator car to the area behind the flap;

wherein the flap has a height that is less than the height of the side walls;

wherein the ladder is arranged in the area behind the flap in the closed state of the flap;

whereby the ladder is removable from the area behind the flap and is expandable in length for use in the evacuating persons from the interior of the elevator car;

wherein the flap has a holding arrangement for detachably securing the ladder to a side of the flap that is opposite to the interior of the elevator car; and another ladder removably attached at an outside of a side of the elevator car and adapted to be removed from the side and positioned for use in getting passengers from a roof of the elevator car to an exit from an elevator shaft in which the elevator car is movable while the ladder in the interior of the elevator car remains available to evacuate persons.

2. The elevator car according to claim 1 wherein the height of the flap is less than a half of the height of the side walls.

3. The elevator car according to claim 1 whereby the flap is attached to a structure in a lower area of the elevator car by a hinge arrangement so that the flap can be opened to the open state by rotating the flap around a horizontal axis of rotation at the hinge arrangement.

4. The elevator car according to claim 1 wherein the ladder is a telescopic ladder.

5. The elevator car according to claim 1 wherein the ladder has several longitudinally connectable parts.

6. The elevator car according to claim 1 wherein the flap has a locking arrangement for releasably locking the flap in the closed state.

7. The elevator car according to claim 6 wherein the locking arrangement is adapted to be locked and unlocked with a separate tool.

8. The elevator car according to claim 1 wherein the flap in the closed state is flush with the side wall on which the flap is arranged.

9. The elevator car according to claim 1 wherein the flap is a part of a wall box accommodated in the side wall on which the flap is arranged.

10. The elevator car according to claim 1 including an exit hatch arranged in the ceiling of the elevator car.

11. The elevator car according to claim 1 wherein the ladder has a length in an extended state that is equal to or greater than the height of the side walls.

12. The elevator car according to claim 1 including a fixing device located on an outside of the elevator car and being adapted to affix the ladder to the outside of the elevator car.

13. An elevator car, comprising:

a plurality of side walls, a floor and a ceiling together enclosing an interior of the elevator car, whereby the floor and the ceiling are distanced from each other by a height of the side walls;

a ladder for evacuating persons from the interior of the elevator car;

a flap arranged on one of the side walls of the elevator car;

wherein the flap is movable through a rotating movement between a closed state whereby the flap blocks access from the interior of the elevator car to an area behind the flap, and an open state whereby access is possible from the interior of the elevator car to the area behind the flap;

wherein the flap has a height that is less than the height of the side walls;

wherein the ladder is arranged in the area behind the flap in the closed state of the flap and the ladder is detachably affixed to a back side of the flap that is opposite to the interior of the elevator car; and whereby the ladder is removable from the area behind the flap and is expandable in length for use in the evacuating persons from the interior of the elevator car.

14. The elevator car according to claim 13 wherein the flap has a holding arrangement for detachably securing the ladder to the back side of the flap.

15. An elevator car, comprising:

a plurality of side walls, a floor and a ceiling together enclosing an interior of the elevator car, whereby the floor and the ceiling are distanced from each other by a height of the side walls;

a ladder for evacuating persons from the interior of the elevator car;

a flap arranged on one of the side walls of the elevator car;

wherein the flap is movable through a rotating movement between a closed state whereby the flap blocks access from the interior of the elevator car to an area behind the flap, and an open state whereby access is possible from the interior of the elevator car to the area behind the flap;

wherein the flap has a height that is less than the height of the side walls;

wherein the ladder is arranged in the area behind the flap in the closed state of the flap whereby the ladder is removable from the area behind the flap and is expandable in length for use in the evacuating persons from the interior of the elevator car;

wherein the flap has a holding arrangement for detachably securing the ladder to a side of the flap that is opposite to the interior of the elevator car; and a fixing device located on an outside of the elevator car and being adapted to attach the ladder to the outside of the elevator car for use in getting passengers from a roof of the elevator car to an exit from an elevator shaft in which the elevator car is movable.

* * * * *